United States Patent [19]

Peckels

[11] Patent Number: 4,976,297

[45] Date of Patent: Dec. 11, 1990

[54] FUNNEL HAVING IMPROVED LIQUID FILL LEVEL INDICATOR

[76] Inventor: Arganius E. Peckels, Rte. 2, P.O. Box 489, Ogilvie, Minn. 56358

[21] Appl. No.: 438,586

[22] Filed: Nov. 17, 1989

Related U.S. Application Data

[63] Continuation of Ser. No. 220,573, Jul. 20, 1988, abandoned, which is a continuation-in-part of Ser. No. 196,501, May 20, 1988.

[51] Int. Cl.[5] ..... B65B 39/04; B67C 11/00

[52] U.S. Cl. ..... 141/95; 141/96; 141/288; 141/297; 141/300; 141/331; 73/294; 116/109; 116/112; 116/227

[58] Field of Search ..... 141/947, 96, 288, 297, 141/300, 331–345, 368; 73/294, 305, 306, 314, 319, 322, 322.5; 116/108, 110, 112, 70, 227, 228; 137/558

[56] References Cited

U.S. PATENT DOCUMENTS

| | | | |
|---|---|---|---|
| 42,024 | 3/1864 | Smedley | 141/95 |
| 127,506 | 6/1872 | O'Laughlen | 141/95 |
| 374,875 | 12/1887 | Lyman | 141/95 X |
| 790,463 | 5/1905 | Taliaferro | 73/294 |
| 843,873 | 2/1907 | De Veaux | 141/300 |
| 1,676,986 | 7/1928 | Hilford | 141/300 |
| 2,391,040 | 12/1945 | Scully | 141/96 |
| 2,666,557 | 1/1954 | Hester | 141/288 |
| 2,703,194 | 3/1955 | White | 141/96 |
| 2,831,452 | 4/1958 | Haynes | 116/109 X |
| 2,910,097 | 10/1959 | Madsen | 141/96 |
| 3,136,295 | 6/1964 | Gramo | 141/95 |
| 3,420,281 | 1/1969 | Tidwell | 141/288 X |
| 4,202,386 | 5/1980 | Orr | 141/300 |

*Primary Examiner*—Ernest G. Cusick
*Attorney, Agent, or Firm*—Henry C. Kovar

[57] ABSTRACT

An apparatus and a method for filling vessels with liquid has a non-electric fill indicator having an air passageway leading up and out of the vessel to an air flow indicator, air escaping during filling causes the indicator to whistle and when the whistle stops, the vessel is filled and the user stops filling. The air flow is not stopped until the height level of opened air inlet port is covered by the vessel liquid. The funnel has a full height slot along one side and a vertically slidable air tube in the slot; air is admitted transversely into an aperture through the tube with the aperture being vertically movable along with the tube for easy adjustment of relative fill level.

19 Claims, 4 Drawing Sheets

FUNNEL HAVING IMPROVED LIQUID FILL LEVEL INDICATOR

RELATED APPLICATIONS

This is a co-pending continuation application based upon my U.S. Ser. No. 220,573 filed July 20, 1988, now abandoned, which was a co-pending continuation-in-part application based upon my U.S. Ser. No. 196,501, filed May 20, 1988.

BACKGROUND OF THE INVENTION

This invention pertains to a funnel having an improved liquid fill level indicator and to a method of indicating when a fill level has been reached.

THE PRIOR ART

The manual filling of gasoline and fuel tanks from small transfer cans of the usual ½ to 6 gallon capacity is a sloppy procedure. The same holds true for the filling of these transfer cans as well as outboard motor cans, Jerry cans, boat tanks and so forth. Small fuel tanks are typically found of outboards, mowers, chainsaws, tillers, snowblowers, garden tractors, pumps, full size tractors, trucks, boats, generators, welders, cement and stucco mixers and so on. The typical practice is to fill these tanks until they overflow Fuel then is spilled onto the ground or on the machine. This is a mess, it stinks, and its environmentally obectionable. It's quite common to fill these tanks at night or in relatively dark places when and where the filler can't see what's happening until the fuel runs over and splashes on the outside of the tank.

Much the same holds true for pesticides, herbicides, cleaning solutions, soft drink syrups, antifreeze, acids, alkalis, solvents, hot water and other liquids; they are all a problem to manual fill and tell when the receiving vessel is filled.

Spillage of these liquids is economically and environmentally objectionable.

OBJECTS OF THE INVENTION

It is an object of the present invention to provide a liquid funnel having improved structure for indicating when a vessel is filled.

It is an object of the present invention to provide an improved method of filling and a liquid funnel having an acoustical level control.

It is an object of the present invention to provide an improved method of filling and a liquid funnel with adjustment of indicated fill level.

It is an object of the present invention to provide an improved liquid vessel having an adjustable fill level indicator.

It is an object of the present invention to provide an improved structure of a funnel with an adjustable level air vent and fill indicator.

SUMMARY OF THE INVENTION

According to the principles of the present invention a liquid funnel has a generally tubular body with inlet and outlet ends, structure on the outet end for sealing the funnel to a vessel inlet, a discrete, and relatively adjustable air tube extending upright the inside of the funnel, and structure on the air tube outlet end for indicating when air flow through the tube has been stopped by the level of liquid in the vessel.

A liquid funnel has a body with inlet and outlet ends, a discrete air passageway between the inlet and outlet ends, and an upright and elongate air inlet through the side funnel body and into the air passageway.

An air vent and fill level indicator for a liquid vessel has an elongate air tube with inlet and outlet ends, an indicator on the outlet end for indicating passage or no passage of air therethrough, and a handle connected to the tube for manipulating the tube along up and down the tubes length while the tube has its inlet in the vessel.

Many other advantages, features and additional objects of the present invention will become manifest to those versed in the art upon making reference to the detailed description and accompanying drawings in which the preferred embodiment incorporating the principes of the present invention is set forth and shown by way of illustrative example.

DESCRIPTION OF THE PREFERRED EMBODIMENT

Figures 1, 2:
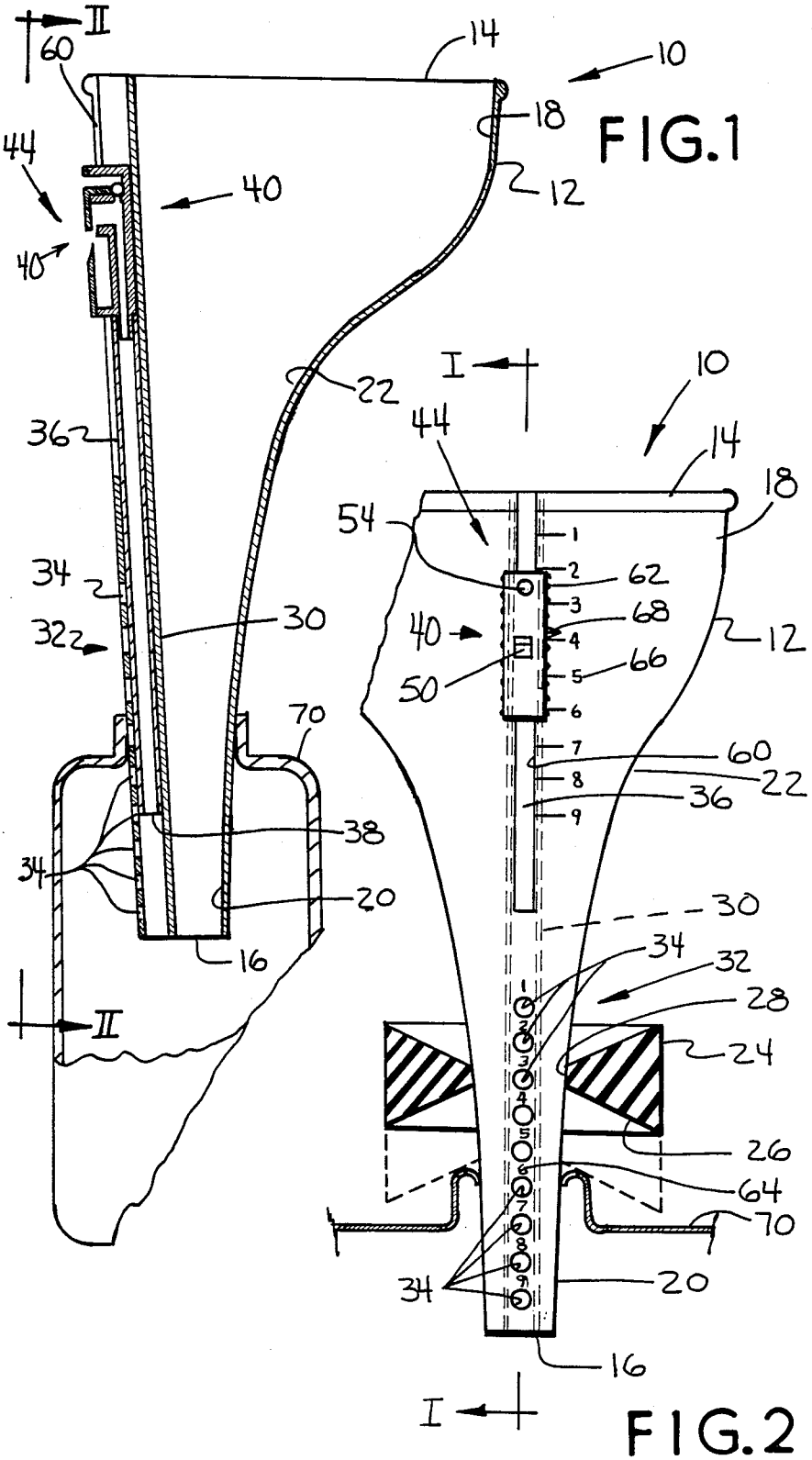
FIG. 1 is an elevational side view, in section, of the preferred embodiment of the funnel of the present invention.
FIG. 2 is a second elevational side view, taken from lines II—II of FIG. 1.
Figure 3:
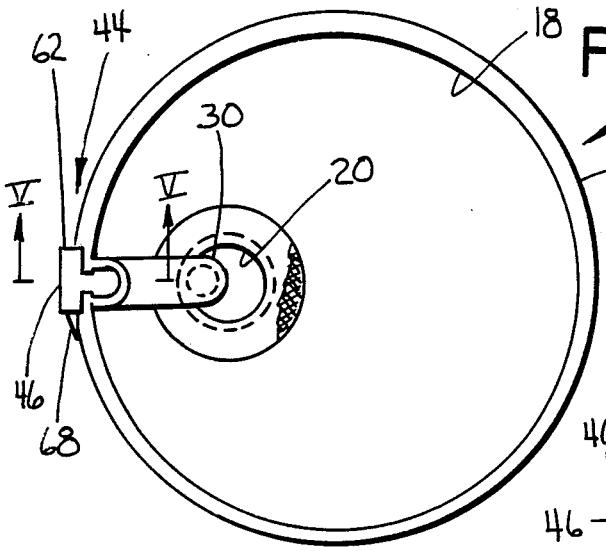
FIG. 3 is a top plan view of the structure of FIG. 1.

A liquid funnel for filling liquid vessels is shown in FIGS. 1–4 and is generally indicated by the numeral 10.

The funnel 10 has an upright generally tubular body 12 having an inlet end 14 and an outlet end 16. The inlet end 14 leads downward into a relatively large cross section and relatively large volume hopper 18. The outlet end 16 leads upward in and through a relatively small diameter discharge pipe 20. A relatively radial expanding cross-sectional area, which can be referred to as a flared section 22, is about midway between the inlet end 14 and the outlet end 16 and fluidly adjoins the hopper 18 to the discharge pipe 20. The discharge pipe 20 has a tubular frusto conical section and has its smallest diameter at the outlet end 16. The discharge pipe 20 divergently tapers to a larger diameter away from the outlet end 16 and eventually adjoins the flared section 22. The exterior surface of the generally frusto-conical discharge pipe 20 preferrably has a concave curvature as seen from the outside as clearly seen in FIGS. 1 and 2. The discharge pipe 20 is sized and shaped to fit within and generally seal to the filling inlet aperture of fluid vessels.

It will be appreciated the discharge pipe 20 is sized and shaped for a reasonably similar group of vessels As an example, a given single funnel 10 may have its discharge pipe sized for the fuel tank fill apertures of mowers, garden tractors, tillers, snowblowers, small generators, and other relatively small domestic equipment. Another specific funnel 10 may be sized for boat fuel tanks. Another specific funnel may be sized for full size tractors and the like. Regardless, the discharge pipe 20 is sized and shaped to fit in and provide a reasonable, but not perfect, air tight seal between the discharge pipe 20 and the filling inlet aperture of the vessel to be filled The concave exterior shape of the discharge pipe 10 helps seal the discharge pipe 20 to the filling inlet. There is at least one frequently encountered exception to the foregoing and this is the bayonet lock slotted filling aperture and cap on outboard fuel tanks in order to seal to a slotted bayonet lock filling aperture, the discharge pipe 20 is provided with an external toroidal seal ring or element 24 that will slide up and down on the discharge pipe 20. The seal ring 24 is a soft resilient element made out of a soft elastomer, thermoelastomer, closed cell foam or simiar material. The seal element 24 has a first downward facing annular face sealing surface 26 and a second inner radial shaft or tube seal 28 that is sealing engagable with and against the outside surface of the discharge pipe 20. As at least part and preferrably most of the upright length of the discharge pipe 20 is inserted into a slotted bayonet lock fill spout as best seen in FIG. 2, the seal ring 24 is pushed down against the spout and the face seal 26 provides a sufficiently air tight seal for the operation to be subsequently explained.

The funnel body 12 also includes a discrete internal relatively small diameter tubular section 30 that preferrably extends most or all of the way from the outlet end 16 to the inlet end 14. The tubular section 30 is open into the tubular section 30 on the inside of the funnel body 12 and is completely within the discharge pipe 20. A vertically elongate air inlet port generally indicated by the numeral 32 is through the exterior wall of the body 12, and specifically through the wall of the discharge pipe 20. The elongate air inlet port 32 has a height which is at least the majority of the height of the discharge pipe 20. The preferred structure of the air inlet port 32 is a plurality of aligned and spaced apart air aperture ports 34 that extend all the way up from the outlet end 16 to a level adjacent to the flared section 22.

Inside of the internal tubular section 30 is a discrete elongate air tube 36. The air tube 36 has a co-movable air inlet 38 which is adjacent and which lowered is preferrably co-planar with the body outlet end 16, and an air outlet end 40 adjacent the body inlet end 14. An open and relatively unobstructed air passageway 42 extends the height of the air tube 36 from the air inlet 38 to the air outlet end 40. The air tube 36 is slidably mounted inside the tubular section 30 and can be repeatedly pulled up and pushed back down within the funnel body 12.

Figure 5:
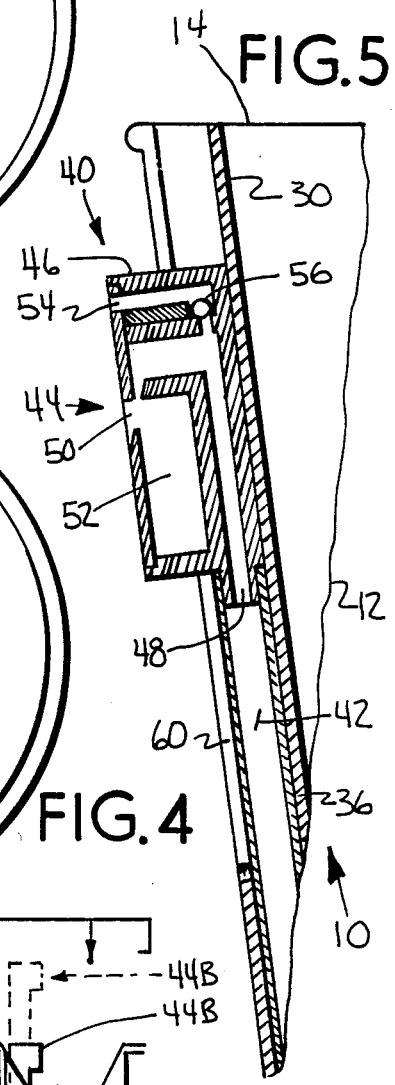
FIG. 5 is an elevational side view, in section and in detail, of the indicator of the structure of FIG. 1 as viewed through lines V—V of FIG. 3.
Figure 4:
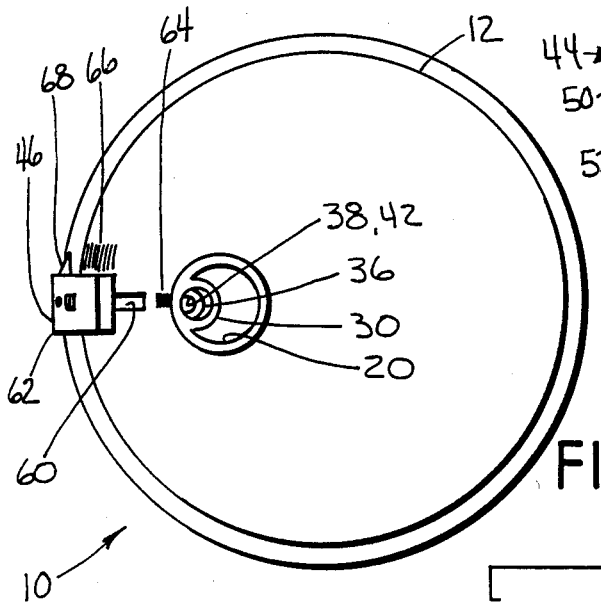
FIG. 4 is a bottom plan view of the structure of FIG. 1.

At the tube air outlet end 40 is an air flow indicator generally indicated by the numeral 44 that has structure for indicating whether or not air is flowing outward through the air tube 36. The specific construction of the air flow indicator 44 is best shown in FIG. 5. An indicator housing 46 has an air inlet 48 connected to the air tube 36. The air passageway 42 extends up and through the indicator housing 46 to an air outlet 50. Fluidly adjoined to the air outlet 50 is an acoustical resonance chamber 52 which makes the air flow indicator 44 audibly whistle when air is flowing up through the air tube 36 and out of the indicator air outlet 50. An air flow regulator outlet 54 is fluidly connected in parallel with the indictor air outlet 50 to the air tube 36. The regulator outlet 54 has a normally closed ball valve 56 that normally obstructs air flow through the regulator outlet 54. However, if and when the fill rate through the funnel 10 becomes excessive, the ball valve 56 will open and allow corresponding increased flow of air up and out of the air tube 36. The indicator housing 46, as best seen from the top in FIG. 3 has a generally T-shaped cross section with the central leg of the T-shape being in the tubular section 30 and with the head 58 of the T-shape being outside of the funnel body 12. The indicator housing 46 projects out of the funnel body 12 through an elongate adjustment slot 60 extending down from the funnel outlet end 16 and through the wall of the hopper 18 into the tubular section 30. A normally graspable handle 62 is formed in the indicator housing 46 for manual grasping and raising and lowering of the air tube 36 and the air inlet in the tubular section 30. A first fill height gauge 64 is provided adjacent the elongate air inlet port 32 and a second pill height gauge 66 is provided adjacent the indicator housing 46 and the adjustment slot 60. The handle 62 preferrably has a height reference indicator 68.

In the use and operation of the funnel 10 and in the practice of the method of the present invention, the discharge pipe 20 of the funnel 10 is inserted into the fill aperture of a vessel to be filled with liquid The fill aperture may be of unknown diameter The concave exterior tapered surface of the discharge pipe 20 is sealed against the vessel inlet aperture. The user then looks at the side of the funnel 10 and in particular at the first pill height gauge 64 which will indicate how far the discharge pipe 20 is inserted into the vessel. The user then grasps the handle 62 and slides the air flow indicator 44 and air tube 36 up or down in the funnel body 12 as required until the indicator 68 on the second pill height gauge 66 is pointing at and is matched up with a quantity that corresponds to the quantity showing in the first pill height gauge 64 at the vessel fill aperture. This adjustment of the air tube 36 up and down, likewise adjusts the air tube air inlet 38 up and down to a predetermined height which is appropriately spaced below the level of the vessel fill aperture. The user then begins to pour liquid into the funnel 10. The liquid flows through the funnel body 12 and out of the body outlet end 16. As the liquid is flowing in, the air in the vessel is being displaced and must escape.

The escaping air goes up and out the air tube 36 via the air passageway 42 and goes out the air outlet 50 whereupon it causes the air flow indicator 44 to emit a shrill and easily heard whistle. The whistle sound continues as long as the vessel is being filled and as long as air is escaping out the air tube 36. As soon as the level in the vessel reaches the tube air inlet 38, the flow of air stops and the acoustic whistle stops and the user stops pouring because the vessel is filled. In as much as vessels vary, fill levels vary, and inlet apertures vary, the user most often never knows in advance where this fill level will be with respect to the funnel body 12 after the funnel 10 is inserted into the vessel. The height gauges 64, 66 enable the pill air tube 36 and air tube inlet 38 to be properly adjusted for a maximum fuel fill level or for the fill level to be adjusted downward from the top of the vessel. The liquid level reaching the funnel outlet end 16 may but does not necessarily stop the escaping air flow and whistle sound. As an example, if the discharge pipe 20 is inserted into the vessel up to the level of gauge mark "3" on the lower and first pill height gauge 64, the tube 36 and air inlet 38 will likewise be pulled up and raised in the funnel body 12 until the height indicator 68 is at the corresponding numeral "3" on the upper and second pill height gauge 66. The tube air inlet 38 will then be some predetermined distance below the mark "3" on the first pill height gauge 64, i.e, one inch below. The user of the funnel 10 will then be given an acoustical signal to stop filling when the liquid level is the predetermined distance, i.e. one inch below the top of the vessel. When the air tube 36 and air inlet 38 are raising up as just described, the fluid level in the vessel will reach the funnel outlet end 16 but not stop air flow. The air flow escapes out of the vessel by going through the uncovered individual air ports 34 until the highest uncovered air port 34 is covered by liquid at which time air flow stops and the indicator 44 so indicates by stopping the whistle sound. The indicator 44 indicates when air flow stops, and a full vessel is a consequence of the stoppage of air flow.

Figure 6:
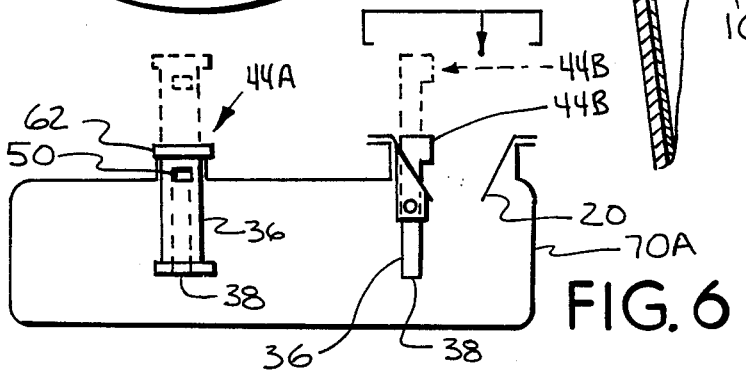
FIG. 6 is an elevational side view, in section, of a liquid vessel having the present invention therein.
Figure 7:
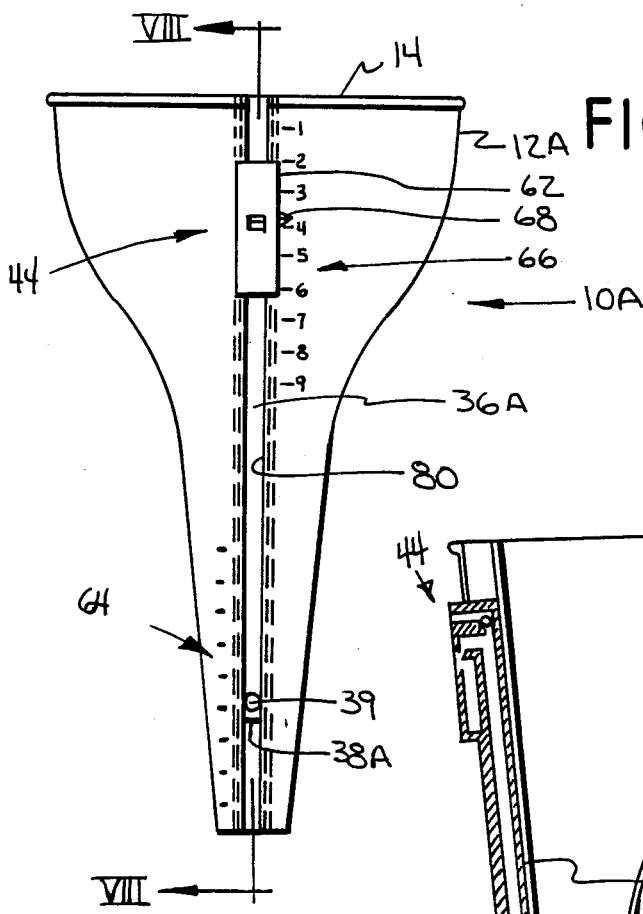
FIG. 7 is a side elevational view of an alternative and improved construction of a funnel according to the present invention.
Figure 8:
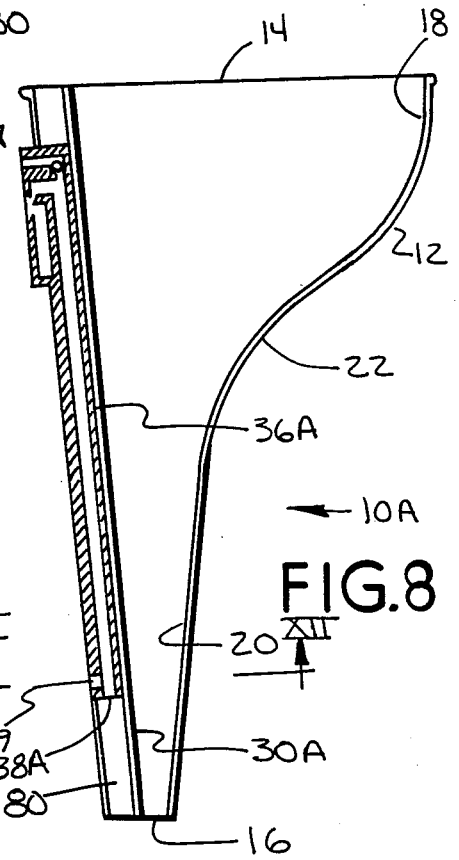
FIG. 8 is a side elevational view in section taken through lines VIII—VIII of FIG. 7.
Figure 9:
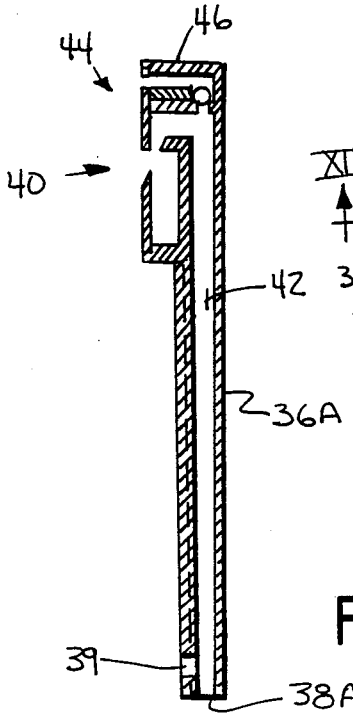
FIG. 9 is a side elevational view in section taken through lines VIII—VIII of FIG. 7 of the air discharge pipe in the funnel.
Figure 10:
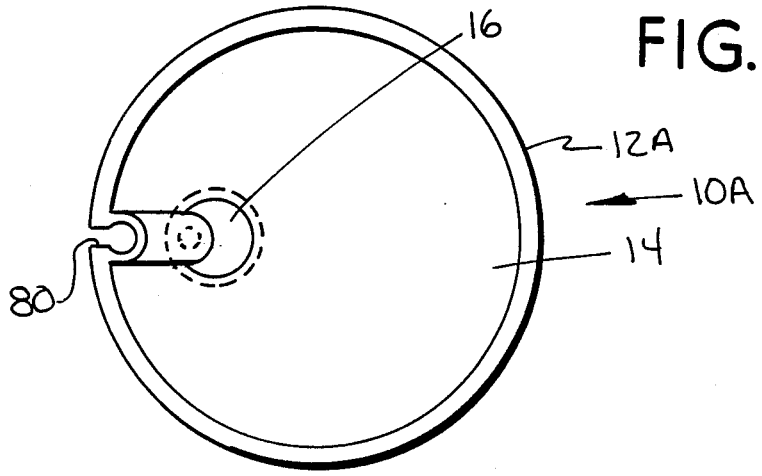
FIG. 10 is a top plan view of the structure of FIG. 7.
Figure 11:
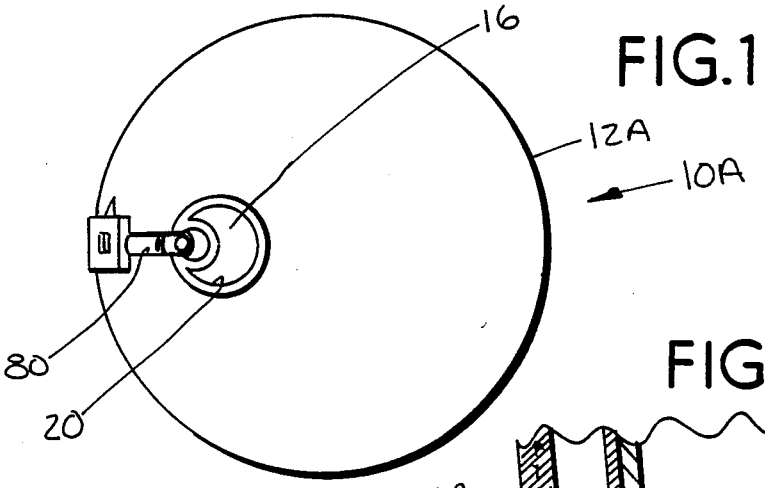
FIG. 11 is a bottom plan view of the structure of FIG. 7.

The invention and method may be installed and used integrally in a liquid vessel 70 as is shown in FIG. 6.

Figure 12:
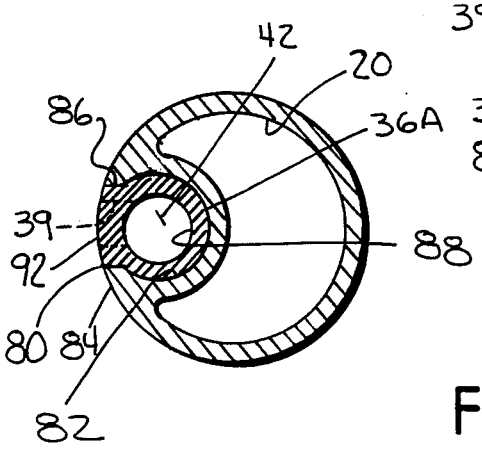
FIG. 12 is a cross sectional view through lines XII—XII of FIG. 7.

FIGS. 7–12 illustrate a new and improved funnel 10A having an improved air tube 36A. The funnel 10A has an improved body 12A which is generally the same as the body 12 of FIGS. 1 & 2 but which has a new and improved air vent structure. The funnel body 12A has an elongate vertical slot 80 which extends from the top 14 to the bottom 16 of the funnel body 12A. The slot 80 preferrably has a generally keyhole shaped cross-section as best seen in FIG. 12 with a diametric portion 82 of less than 360 degrees being spaced inwardly of an outer surface 84 of the funnel body 12A and a leg portion 86 having a width which is less than the diameter of the diametric portion 82. The leg portion 86 is preferrably perpendicular to the funnel outer surface 84 and open through the funnel outer surface 84 which enables economically effective injection molding of the funnel body 12A. The outer surface 84 of the funnel body 12A is not a complete 360 degrees round and is void where the slot 80 projects through the outer surface 84.

Figure 13:
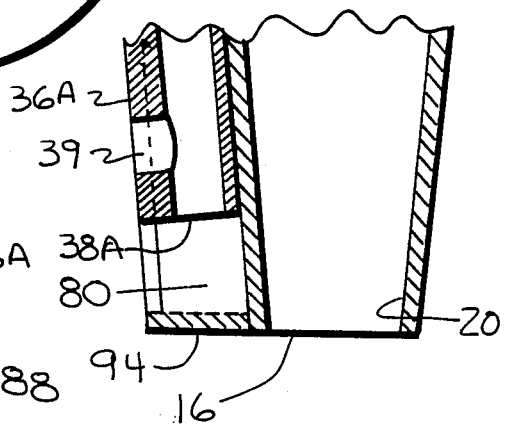
FIG. 13 is a cross sectional view through the discharge spout of FIG. 7, with an optional barrier being shown.

The alternative and improved air tube 36A has a cross-section having a shape generally like a skeleton key that is complimental to and which slip fits in the keyhole shaped slot 80. The air tube 36A has a tubular section 88 and a leg section 90 which is in the slot 80 and projecting outward from the tubular section 88. The leg section 90 has an outer surface 92 which is geometrically common with and extends and completes the cylindrically shaped outer surface 84 of the funnel body. This leg outer surface 92 is continuous along the vertical height of the air tube 36A. The alternative air tube 36A may have an open bottom and a bottom air inlet 38A identical to that on the air tube 36 of FIG. 1. The improved air tube 36A preferrably has a transverse air inlet 39 which extends transversely into and through the tubular section 88 through the slot leg portion 86. The transverse air inlet 39 may extend through the air tube leg 90 as is shown. The bottom of the slot 80 may be closed with a liquid barrier 94 as shown in FIG. 13 to help prevent incoming liquid from being drawn into the air pipe 36 by escaping air.

The funnel body 12A and air tube 36A of the improved embodiment are mass producible and quality can be economically maintained using the techniques of injection molding and extrusion. The body 12A and air tube 36A can be made of appropriate softness poly plastics and/or thermoplastic rubbers that can be injection molded and/or extruded.

In the use and operation of the improved funnel 10A, the funnel 10A is placed in the liquid (i.e. fuel) inlet of a vessel and the entire air pipe 36A is adjusted up and down appropriately as has previously been described. The air inlet 38A, 39 into the tube 36A still comes in transversely through the funnel wall of the body 12A and in particular through the wall of the discharge spout 20. The escaping air is now taken in transversely through transverse air inlet 39 into the passageway 42 which eliminates any tendency for escaping air to draw up incoming liquid.

When the funnel 10A is placed into the vessel, both the outer surface of the funnel body 12A and the leg outer surface 92 of the air tube 36A jointly seal the funnel 10A to the liquid inlet. If extremely high filling flow rates are desired, the air pipe 36A can be removed from the top of the funnel body 12A and the body 12A can be used without the fill indicator 44. As the tapered discharge pipe 20 is pushed down into the vessel fill inlet, the pipe 20 tends to compress upon and seal and lock the air pipe 36A in position.

These funnels 10, 10A and methods are particularly well suited for filling fuel tanks, and for filling after dark in time and places where its hard to see. These funnels 10, 10A are quite adaptable to many different kinds of vessels and fill apertures. These funnels 10, 10A and methods are extremely useful in any household, business or location wherein a vessel needs to be manually filled.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A liquid funnel having structure for indicating when a liquid receiving vessel is filled, comprising (a) a generally tubular funnel body having an inlet end, an outlet end, and an outer wall having a length extending between said ends;

(b) an elongate upright slot extending along the length of the outer wall from adjacent the inlet end to adjacent the outlet end, said slot being open through the outside of said outer wall of the body;

(c) a discrete air tube having an air inlet adjacent the body outlet end and an air outlet adjacent the body inlet end, said air tube being fitted within and being extended upright in said slot;

(d) indicator means on said air tube outlet end for indicating air has stopped flowing through said tube upon the vessel being filled to the air inlet; and (e) funnel body outer surface means at said outlet end being contiguous, and jointly defined in part by said funnel body and in part by said air tube for effectively sealing said funnel to a liquid inlet of the vessel.

2. The funnel of claim 1, in which said slot extends along the entire upright length of said outer wall.

3. The funnel of claim 2, in which said slot is open through the outside of the entire upright length of said outer wall.

4. The funnel of claim 1, in which said slot has a generally keyhole shaped cross-section.

5. The funnel of claim 4, in which said air tube has a complemental generally keyhole shaped cross-section that is slip fitted within said generally keyhole shaped slot.

6. The funnel of claim 5, in which the entire height of said air tube has said keyhole shaped cross-section.

7. The funnel of claim 1, in which said air tube has an upright air inlet, and a transverse air inlet through said funnel outer surface means.

8. The funnel of claim 1, in which said air tube is movable up and down within said slot.

9. The funnel of claim 8, in which the funnel body is of an injection molded plastic, and in which the outer wall is compressible upon the air tube, to seal and hold the movable air tube in a desired position.

10. The funnel of claim 9, in which said slot and said air tube are both generally keyhole shaped in cross-section, and in which said air tube is extruded plastic.

11. The funnel of claim 8, including adjusting means above said funnel outer surface means, said adjusting means being connected to said air tube and being extended transversely through and out of said slot adjacent to said inlet end, for adjusting the air tube up and down in said funnel when said funnel is in a filling position in the vessel.

12. The funnel of claim 11, including a first height gauge on said body adjacent the funnel outlet end, and a second height gauge on said body adjacent to said adjusting means.

13. A liquid funnel having (a) a body with an inlet end and an outlet end and a liquid passageway therebetween;

(b) an upright slot in said body from the inlet end to the outlet end, said slot being directly open to the outside of the body along the entire height of said slot;

(c) a discrete air tube movably mounted in said slot, said air tube, having an air passageway between said inlet end and said outlet end;

(d) an air inlet port extending transversely through said slot from the outside of the funnel to said air passageway, said air inlet port starting adjacent said funnel outlet end and extending upward toward said inlet end, and (d) adjusting means extending transversely through and out of said slot adjacent to said inlet end, said adjusting means being movable up and down in said slot and being connected to said air tube for adjusting the effective height of said air inlet port up and down in said funnel when said funnel is in place in a liquid inlet of vessel to be filled.

14. The funnel of claim 13 in which said slot and said air tube are generally keyhole shaped.

15. The funnel of claim 14, in which said funnel body is plastic and is compressible upon said air tube.

16. The funnel of claim 14, in which said air tube has an upright air inlet and a transverse air inlet through said funnel body.

17. The funnel of claim 16, in which said body has a liquid barrier closing a bottom of said slot.

18. The funnel of claim 14, including a height gauge on said body adjacent to the outlet end, and a second height gauge on said body adjacent to the inlet end.

19. The funnel of claim 18, in which each of said height gauges are on the outside of said body.

* * * * *